US005760756A

United States Patent [19]

Kobayashi et al.

[11] Patent Number: 5,760,756

[45] Date of Patent: Jun. 2, 1998

[54] ERROR VARIANCE CIRCUIT

[75] Inventors: Masayuki Kobayashi; Masamichi Nakajima; Asao Kosakai; Junichi Onodera; Hayato Denda, all of Kanagawa-ken, Japan

[73] Assignee: Fujitsu General Limited, Kanagawa-ken, Japan

[21] Appl. No.: 558,513

[22] Filed: Nov. 16, 1995

[30] Foreign Application Priority Data

Nov. 17, 1994 [JP] Japan ..... 6-307117

[51] Int. Cl.[6] ..... G09G 3/36

[52] U.S. Cl. ..... 345/87; 345/60; 345/147

[58] Field of Search ..... 345/87, 88, 98, 345/99, 100, 147, 148, 149, 60, 61, 63, 55, 58

[56] References Cited

U.S. PATENT DOCUMENTS 5,089,812 2/1992 Fuse et al. ..... 345/147

5,122,792 6/1992 Stewart ..... 345/148

*Primary Examiner*—Xiao Wu

*Attorney, Agent, or Firm*—McDermott, Will & Emery

[57] ABSTRACT

An error variance circuit, wherein a reproduced error, as detected at an error detection circuit, is added to the image signal of the input signal picture element of n bits, and wherein a variance output signal is converted into a signal of m (≦n−1) bits and outputted to a display panel, includes a clear circuit that clears error at each frame and forcibly reduces the prior error to zero thus preventing excessive noise from preceding frames and non-image duration causing flickering of picture.

9 Claims, 3 Drawing Sheets

ERROR VARIANCE CIRCUIT

BACKGROUND OF THE INVENTION (1) Field of the Invention

This invention relates to an error variance circuit that annihilates the flickering of image due to the error transmission from preceding frames or to the influence of non-image duration in such a display device as plasma display panel (PDP) and liquid crystal panel.

(2) Description of the Prior Art

Recently PDP (Plasma Display has been attracting a great deal of public attention as a thin, light-weight display device. Totally different from the conventional CRT drive system, the drive method of this PDP is a direct drive by means of digitalized image input signal. Consequently, the luminance and tone of the light emitted from the panel face depends on the bit number of the signal to be processed.

PDP may be classified into two types: AC and DC type a whose basic characteristics are different from each other.

The AC type features satisfactory characteristics as far as luminance and durability is concerned. As for the tonal display, a maximum of only 64 tones have reportedly been displayed at the level of trial production.

It is however, proposed to adopt a technique for 256 tones by address/display separate type drive method (ADS sub-field method).

In such an AC device method, the greater the number of tones, the greater the number of bits of the address duration during the preparation time for lighting up and making the panel luminescent within one frame duration. The duration of light emission thus becomes relatively short reducing the maximum luminance.

Because the luminance and tone of the light emitted from the panel face depend upon the number of bits of the signal to be processed, an increased number of the bits of the signal improves the picture quality, but decreases the emission luminance.

If, conversely, the number of bits of the signal to be processed, is decreased, the emission luminance increases, but reduces the tone displayed thereby causing degradation of the picture quality.

The applicant therefore has previously proposed an error variance circuit 28 of false half tone display device, such as shown in FIG. 1, which can minimize the color depth difference between the input signal and emission luminance by rendering the number of bits of the output drive signal smaller than that of the input signal, and at the same time prevent any false patterns even when an image signal of the same level is input continuously.

In FIG. 1, the numeral 30 represents the image signal input terminal of the original picture element A(i,j) consisting of n bits, which is connected to a vertical adder 31 and a horizontal adder 32, reduces the number of bits at the bit conversion circuit 33 and is then connected to the image output terminal 34.

Connected to the output side of the horizontal adder 32 is an error detect circuit 35. The error detect circuit 35 includes a ROM 38 that sets and stores corrected luminance level data for correction of luminance and tone. An adder 39 that operates the sum of the corrected luminance level as set in the ROM 38, and the variance output signal as output from the horizontal adder 32, outputs error detect signal which is weighted in the weighting circuits 40 and 41 and outputs it as a weighted error signal.

The weighting circuits 40 and 41 of the error detect circuit 35 are connected to the vertical adder 31 and horizontal adder 32 through the intermediary of in-line delay circuit 36 and d-dot delay circuit 37, respectively.

The h-line delay circuit 36 "h-line delays the weighted error output signal output from the weighting circuit 40 and outputs, as shown in FIG. 3, a reproduced error of the picture element (pixel), by h-line of the prior original pixel A(i,j). For instance, the reproduced error is E(i,j–l), one line prior, if h=l. On the other hand, the d-dot delay circuit 37 "d-dot delays the weighted error output signal as output from the weighting circuit 41 and outputs the reproduced error at the pixel, by d dots before the original pixel A(i,j), for instance, the reproduced error E(i–l,j) generated by 1 dot prior if d=l.

In FIG. 1, the errors of the h-line delay circuit 36 and the d-dot delay circuit 37 are incorporated and diffused into the variance output signal by the vertical adder 31 and horizontal adder 32. The variance output signal is then sent to the bit conversion circuit 33, where the quantized variance output signal is converted into m ($\leqq$n–l) bits to be output as a drive signal from the image output terminal 34 and supplied to a PDP.

However, this less preferred arrangement was problematical in that if the errors are continuously transferred, the errors from the preceding frames are taken over and an influence is exerted from non-image duration, thus causing the flickering of the picture.

BRIEF SUMMARY OF THE INVENTION

The purpose of this invention is to completely eliminate the flickering of the picture by eliminating any excessive error transfer from the preceding frames and non-image duration.

In order to achieve this objective, this invention comprises a reproduced error adder, a bit conversion circuit 33, and error detect circuits 36 and 37. The error detect circuit 35 is provided with a clear circuit 42. This configuration allows smooth responses to be obtained without reducing the emission luminance despite the fact that the number of bits of the output signal is lower than that of the original image input signal, and forcibly reduces to zero the previous error for every frame unit. The error is thus not transferred to the subsequent frames, thereby eradicating the flickering of the picture.

Since moreover, the frame synchronization signal is sent during the non-image duration, the error can be cleared without exerting any influence on the image.

Other and further objects of this invention will become obvious upon obtaining an understanding of the illustrative embodiments about to be described.

DETAILED DESCRIPTION

Figure 1:
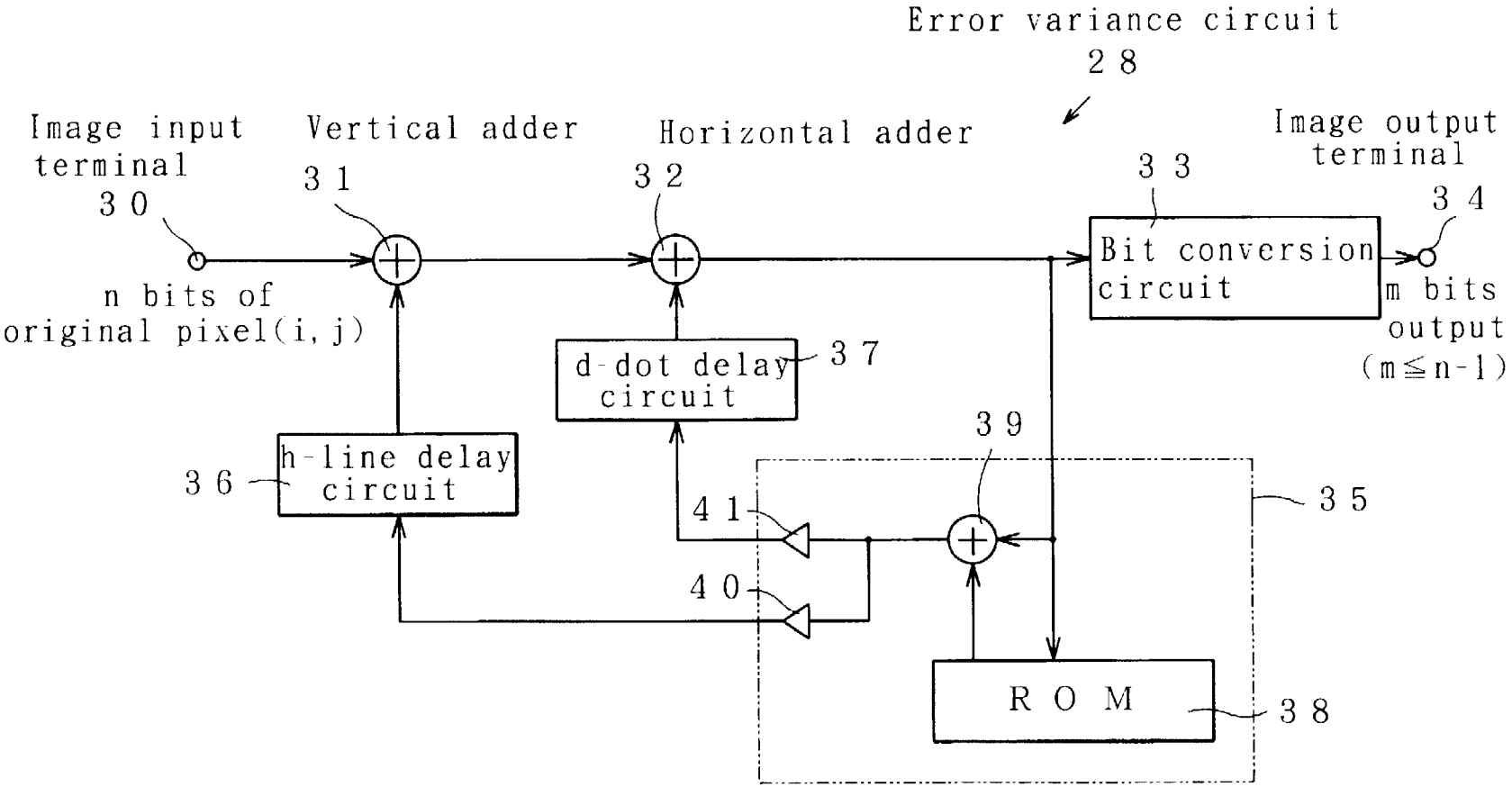
FIG. 1 is a block diagram of a less preferred error variance circuit of a false half tone display device as previously proposed by the applicant.
Figure 2:
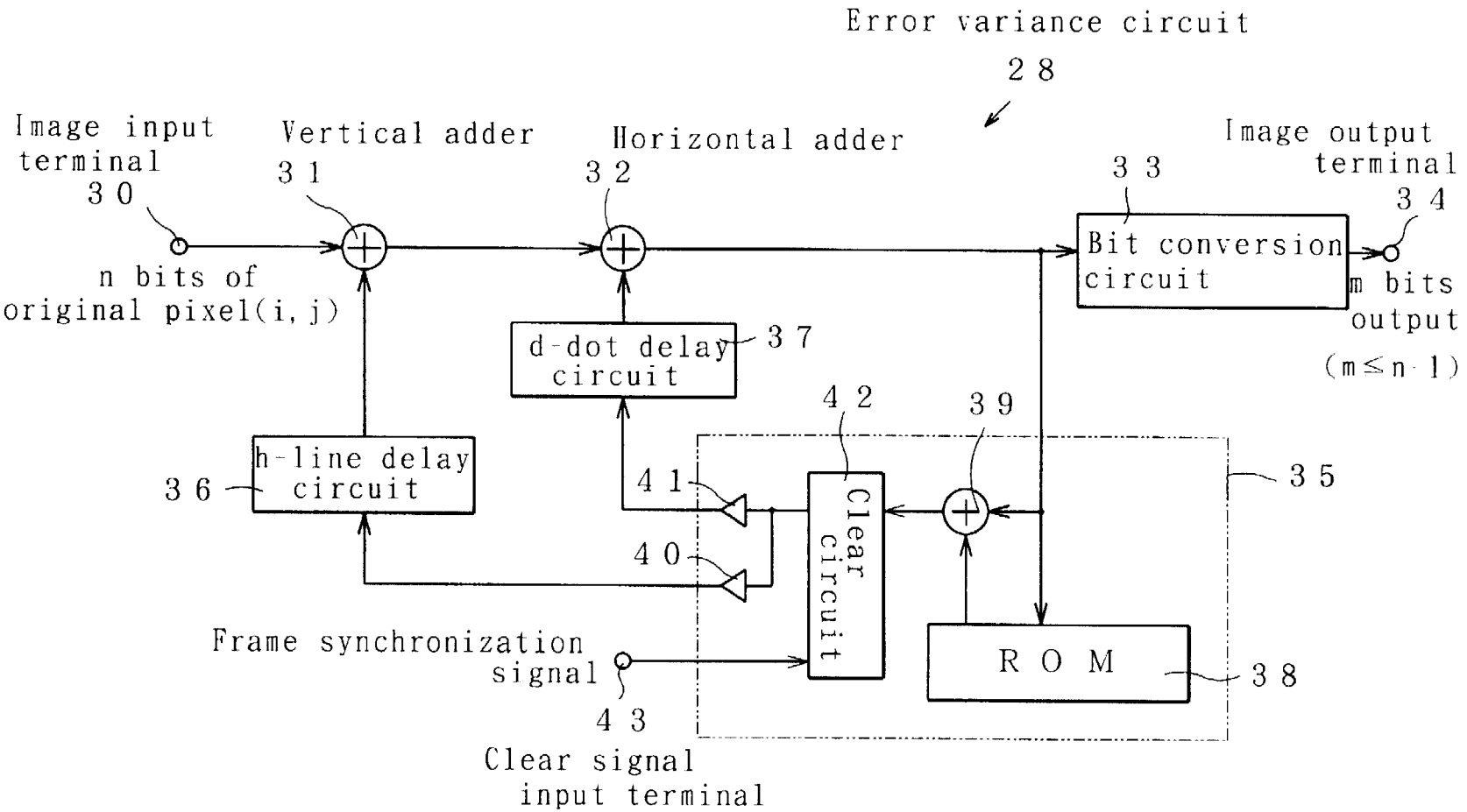
FIG. 2 is another block diagram representing an embodiment of the error variance circuit by this invention.

Referring now in particular to FIG. 2, there is illustrated an embodiment of the error variance circuit by this invention, in which like reference characters denote like parts in FIG. 1.

This invention features the characteristics that the output of the adder 39 of the error detect circuit 35 is connected to a clear circuit 42 to which a clear signal input terminal 43 is connected.

More specifically, the numeral 30 represents the image signal input terminal of original e-bit picture element A(i,j), which is connected to the vertical adder 31 and horizontal adder 32. After the number of bits are reduced at the bit conversion circuit 33, the signal is supplied to the image output terminal 34. The vertical adder 31 and horizontal adder 32 comprise a reproduced error adder.

Connected to the output of the horizontal adder 32 is the error detect circuit 35. The error detect circuit 35 is made of the ROM 38 that sets and stores corrected luminance level data for correction of luminance and tone, the adder 39 that operates the sum of the corrected luminance level as set in the ROM 38 and the variance output signal as output from the horizontal adder 32 to output the error detect signal, the clear circuit 42 that is connected to the output of the adder 39, and the weighting circuits 40 and 41 that are connected to the clear circuit 42 and weight the error detect signal output from the adder 39 and output it as weighted error signal.

Connected to the clear circuit 42 is the clear signal input terminal 43 via which a synchronization signal is input in order to clear the error value by frame unit.

Connected to the outputs of the weighting circuits 40 and 41 of the error detect circuit 35, are the vertical adder 31 and horizontal adder 32 through the intermediary of in-line delay circuit 36 and d-dot delay circuit 37, respectively.

Figure 3:
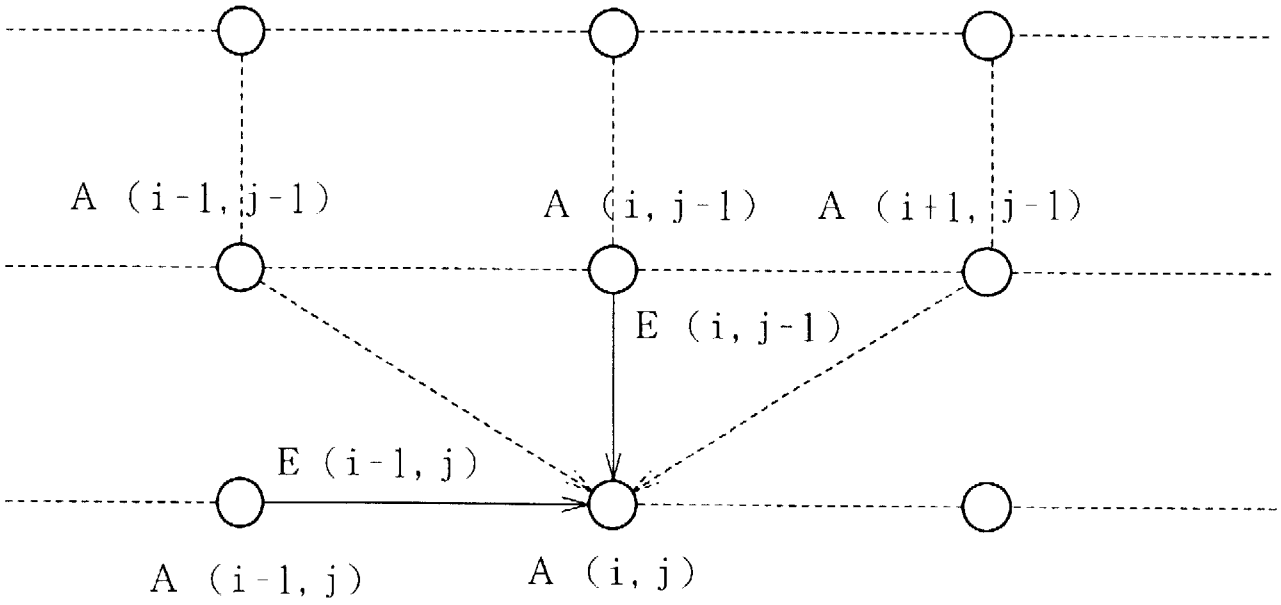
FIG. 3 is an explicative drawing that depicts the error variance processing among respective picture elements.

The h-line delay circuit 36 "h-line" delays the weighted error output signal as output from the weighting circuit 40 and outputs as shown in FIG. 3, a reproduced error of the picture element (pixel), by h-line prior to the original pixel A(i,j), which for instance, the reproduced error is E(i,j−l), one line prior, if h=l. The d-dot delay circuit 37 "d-dot delays the weighted error output signal as output from the weighting circuit 41 and outputs the reproduced error at the pixel, by d dots prior to the original pixel A(i,j), for instance, the reproduced error E(i−l,j) which is generated by 1 dot prior if d=l.

Referring now to the embodiment illustrated in FIG. 2, we will describe the action of this embodiment.

In this embodiment a density is modulated by two luminances and tones to produce a visually false tone within a small area spreading to a certain extent to obtain multiple tone.

Assuming,

A(i,j): input pixel value of the object now under processing,

A(i,j−l): input pixel value, by one line prior (when h=l),

A(i−l,j): input pixel value, by one line prior (when d=l),

δv: error weighted value of the variance output pixel from by 1 line prior

δh: error weighted value of the variance output pixel from by 1 dot, the adder 39 sums up the variance output signal as input into the error detect circuit 35 and the date from ROM 38 to give the error output signal.

The weighting circuits 40 and 41 weight this error output signal into weighted error output signals δv and δh which are weighted by Kv(<l) and Kh(=l−Kv), respectively. These signals are then input into 1-line delay circuit 36 (h=l) and 1-dot delay circuit 37 (d=l) and incorporated into the original pixel A(i,l) by horizontal adder 32 to become $$C(i,j)=A(i,j)+\delta v+\delta h$$

where, C(i,j): variance output pixel value of the object now under processing.

δv=Kvx[f{C(i,j−l)}−Br]

δh=Khx[f{C(i−l,j)}−Br]

f{C(i,j)}: corrected luminance for C(i,j)

Br: emission luminance level.

When the frame synchronization signal is sent for every frame from the clear signal input terminal 43 to the clear circuit 42, the error output signal from the adder 39 is cleared by the clear circuit 42. That is, the prior error is forcibly reduced to zero for every frame. Therefore, it is not transferred to the subsequent frames. Since the frame synchronization signal is sent in a non-image duration, the error value can be cleared without having any influence on the image. The frame synchronization signal can be sent to the clear circuit 42 for every two or more frames with more or less effect.

Thus, the error from preceding frames and any excessive error from the non-image duration can be eliminated. The new errors are incorporated and varied for every frame into the variance output signal, which is then forwarded to the bit conversion circuit 33, where the variance output signal as quantized by n bits is converted into m (≦n−l) bits to be output from the image output terminal 34. The signal fewer in bit number than the original image input signal, thus gives smoother response without reducing the emission luminance.

Though in the foregoing embodiment the reproduced error adder has been made up of the vertical adder 31 and horizontal adder 32, this example is intended to illustrate the invention and is not to be construed to limit the scope of this invention. For example, it is possible to add such a circuit that will add the error in a diagonal direction. The adder may further be built up with the combination with one or more of the vertical adder 31, horizontal adder 32 and diagonal adder.

Although the foregoing embodiment illustrates a case where the display panel is PDP, this invention is not limited thereto; it can make use of any such display panels as liquid crystal display.

What is claimed is:

1. An error variance circuit comprising:

a reproduced error adder that adds a reproduced error generated prior to the original pixel, to an output image signal including an n-bit original pixel, a bit conversion circuit that converts a variance output signal output from said reproduced error adder into a signal of m (n−l) bits and outputs it to a display panel, an error detect circuit that detects a difference between (a) a previously set corrected luminance level or correcting a luminance and a tone of an image produced on the display panel, and (b) the variance output signal, as output from said reproduced error adder and outputs this difference through a weighting circuit, and a delay circuit that delays, for predetermined pixels, the error weighted output signal from the weighting circuit and outputs it to said reproduced error adder as a reproduced error, said error detect circuit including a clear circuit that clears the error every frame.

2. An error variance circuit as claimed in claim 1 wherein the clear circuit clears the errors of preceding frames and those in a non-image duration in response to a frame synchronization signal from a clear signal input terminal.

3. An error variance circuit as claimed in claim 1 or 2 wherein the reproduced error adder comprises any one or more of a vertical adder, a horizontal adder, and a diagonal adder.

4. An error variance circuit as claimed in claim 1 or 2 in which the display panel is either a PDP or a liquid crystal display panel.

5. An error variance circuit having an error diffusion arrangement comprising:

a first adder;

a second adder, said second adder being serially connected between said first adder and a bit conversion circuit;

a first delay circuit connected with said first adder;

a second delay circuit connected with said second adder; and an error detection circuit including:

a clear circuit connected with an output of said second adder;

a first weighting circuit connected between said first delay circuit and said clear circuit for weighting an output the clear circuit; and a second weighting circuit connected between said second delay circuit and said clear circuit for weighting the output of the clear circuit.

6. An error variance circuit as claimed in claim 5, wherein said error detection circuit further comprises:

a ROM which is responsive to the output of said second adder; and a third adder which adds the output of the second adder to an output from said ROM and supplies an output said clear circuit.

7. An error variance circuit as claimed in claim 5, wherein said clear circuit has a clear circuit input terminal which receives a frame synchronization signal.

8. An error variance circuit as claimed in claim 5, wherein said first delay circuit is a horizontal line delay circuit.

9. An error variance circuit as claimed in claim 5, wherein said second delay circuit is a d-dot delay circuit.

* * * * *